US006127877A

United States Patent [19]

Gabara

[11] Patent Number: 6,127,877

[45] Date of Patent: Oct. 3, 2000

[54] RESISTOR CIRCUIT WITH DC VOLTAGE CONTROL

[75] Inventor: Thaddeus J. Gabara, Murray Hill, N.J.

[73] Assignee: Lucent Technologies Inc., Murray Hill, N.J.

[21] Appl. No.: 09/170,165

[22] Filed: Oct. 13, 1998

[51] Int. Cl.[7] ..... G06G 7/12

[52] U.S. Cl. ..... 327/362; 327/345; 327/564; 327/566

[58] Field of Search ..... 327/344, 345, 327/566, 362, 564

[56] References Cited

U.S. PATENT DOCUMENTS

| | | | |
|---|---|---|---|
| 5,567,977 | 10/1996 | Jimenez | 257/538 |
| 5,587,696 | 12/1996 | Su et al. | 338/314 |
| 5,605,859 | 2/1997 | Lee | 437/60 |
| 5,728,615 | 3/1998 | Cheng et al. | 438/238 |
| 5,760,729 | 6/1998 | Rumreich | 341/159 |
| 5,784,692 | 7/1998 | Kleinberg | 455/333 |

*Primary Examiner*—Margaret R. Wambach
*Assistant Examiner*—Cassandra Cox
*Attorney, Agent, or Firm*—Dickstein Shapiro Morin & Oshinsky LLP

[57] ABSTRACT

A resistor circuit having its impedance controlled by a DC voltage is provided. The resistor circuit includes a first resistor with an expected impedance. The circuit also includes a second resistor connected in series with a DC voltage controlled transistor. The first resistor is placed in parallel with the series connection of the second resistor and the transistor. Adjustments to the impedance of the circuit occur by adding or removing the impedances of the second resistor and transistor by varying the DC voltage applied to the transistor. In doing so, the impedance of the resistor circuit will be controlled to match a desired impedance regardless of the variations caused by the manufacturing process, operating temperature or operating power supply voltage.

22 Claims, 2 Drawing Sheets

I-V CHARACTERISTICS OF A MOS TRANSISTOR

RESISTOR CIRCUIT WITH DC VOLTAGE CONTROL

BACKGROUND OF THE INVENTION

1. Field of the Invention

This invention relates generally to the field of integrated circuits and, more particularly, to a resistor circuit with a DC voltage control.

2. Description of the Related Art

Resistors are frequently incorporated into integrated circuits. One well known technique for fabricating and using resistors within an integrated circuit is to deposit a layer or strip of polysilicon material onto a semiconductor substrate. The polysilicon strip, with contacts used to form electrical connections, forms a passive resistor (also referred to in the art as a polysilicon resistor). The polysilicon material has a known resistivity, expressed in $\Omega/cm^2$, and the resistance of the polysilicon resistor is directly related to the length of the polysilicon strip used to form the resistor.

FIG. 1*a* illustrates a polysilicon resistor 10 formed from a layer or strip of polysilicon material 12. The resistor 10 has two contacts 14, 16 used to form electrical connections between the resistor 10 and other circuit elements. As illustrated in FIG. 1*a*, the polysilicon resistor 10 is connected between an input signal IN and a supply voltage $V_{SD}$. FIG. 1*b* illustrates the electrical circuit of FIG. 1*a* including polysilicon resistor 10 of FIG. 1*a* represented by its known impedance $R_{12}$.

Although the use of polysilicon resistors provides an attractive and convenient method for incorporating resistors within integrated circuits, the use of such resistors is not without problems. One known problem, for example, is that the sheet resistance of the polysilicon material varies. The variation can be as large as ±30 percent of the expected impedance. The sheet resistance, and thus, the impedance of the polysilicon resistor, is effected by variations in the manufacturing process. In addition, the impedance of the polysilicon resistor is effected by operating temperature and power supply voltage variations which are difficult to control when the polysilicon resistor is in operational use.

This is a particular problem in applications requiring the polysilicon resistors to be maintained at a precise impedance. In high speed signal transmission environments, for example, the impedance of an integrated circuit that is sending or receiving a signal over a signal path must be a precise value. When a signal exits an integrated circuit, travels an appreciable distance along the signal path and enters another integrated circuit, signal reflections can be experienced from impedance discontinuities at any point along the signal path. These undesirable reflections result in reduced noise immunity and increase the time for the signal to become, and remain, valid at the far end of the signal path. It is well known, however, that when the signal path is viewed as a transmission line with a characteristic impedance, undesirable reflections are eliminated when the transmission line is terminated at the sending and/or receiving ends with an impedance having a value equal to the characteristic impedance of the transmission line.

FIGS. 1*a* and 1*b* illustrate the use of a polysilicon resistor 10 to terminate a transmission line 20 in a high speed transmission environment. The length of the polysilicon material 12 used to create the polysilicon resistor 10 is chosen to match the impedance of the transmission line 20. However, with possible variations as large as ±30 percent of the desired impedance, undesirable reflections and transmission problems may occur.

Accordingly, there is a desire and need for an integrated circuit containing polysilicon resistors with well controlled impedances to overcome resistor impedance variations which may be caused by variations in the manufacturing process, operating temperature or operating power supply voltage.

SUMMARY OF THE INVENTION

The present invention provides a resistor circuit with a well controlled impedance which overcomes impedance variations caused by variations in the manufacturing process, operating temperature or operating power supply voltage.

The above and other features and advantages of the invention are achieved by providing a resistor circuit having its impedance controlled by a DC voltage. The resistor circuit includes a first resistor with an expected impedance. The circuit also includes a second resistor connected in series with a DC voltage controlled transistor. The first resistor is placed in parallel with the series connection of the second resistor and the transistor. Adjustments to the impedance of the circuit occur by adding or removing the impedances of the second resistor and transistor by varying the DC voltage applied to the transistor. In doing so, the impedance of the resistor circuit will be controlled to match a desired impedance regardless of the variations caused by the manufacturing process, operating temperature or operating power supply voltage.

BRIEF DESCRIPTION OF THE DRAWINGS

The foregoing and other advantages and features of the invention will become more apparent from the detailed description of the preferred embodiments of the invention given below with reference to the accompanying drawings in which.

DETAILED DESCRIPTION OF THE PREFERRED EMBODIMENTS

Figure 1A:
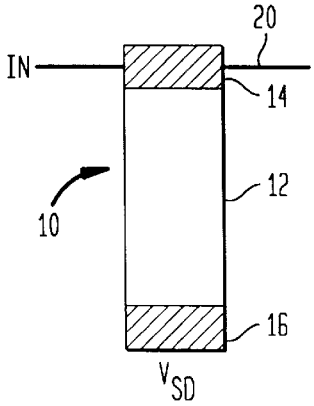
FIG. 1*a* illustrates a conventional resistor circuit including a polysilicon resistor.
Figure 1B:
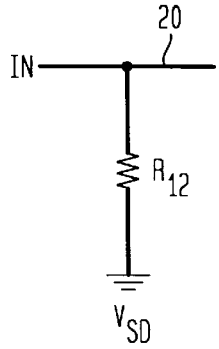
FIG. 1*b* illustrates the resistor circuit of FIG. 1*a* where the polysilicon resistor is represented by its known impedance.
Figure 2A:
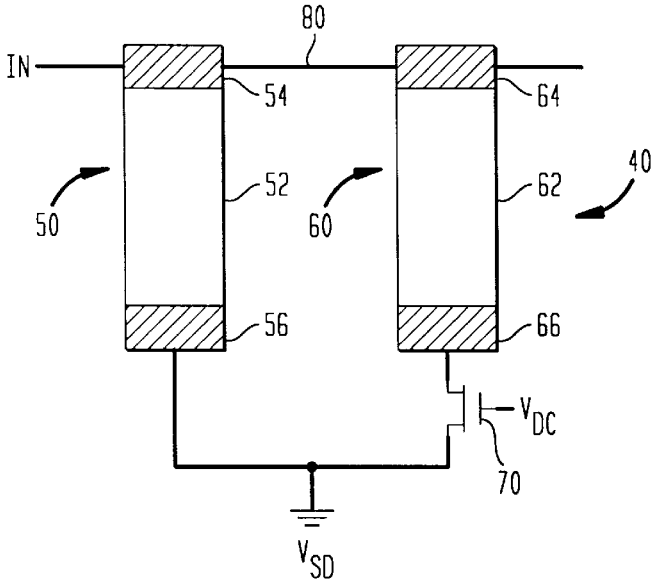
FIG. 2*a* illustrates a resistor circuit constructed in accordance with the present invention.

FIG. 2*a* illustrates a resistor circuit 40 constructed in accordance with the present invention. The circuit 40 includes two polysilicon resistors 50, 60 and a N metal-oxide semiconductor (NMOS) transistor 70. In a preferred embodiment, the circuit 40 is used to terminate a transmission line 80 in a high speed transmission environment. It must be noted that the present invention can be used in any integrated circuit or application requiring a controlled impedance and is not to be limited to a high speed transmission environment. It must also be noted the transistor 70 can be a PMOS transistor or any transistor with similar characteristics as will be described below.

The first polysilicon resistor 50 is formed from a layer or strip of polysilicon material 52. The resistor 50 has two contacts 54, 56 used to form electrical connections between the resistor 50 and other circuit elements. In a preferred embodiment the polysilicon resistor 50 would be connected between the transmission line 80 and a supply voltage $V_{SD}$, where $V_{SD}$ can be equal to the ground potential or any supply voltage. An input signal IN travelling along the transmission line 80 is also illustrated.

The second polysilicon resistor 60 is also formed from a layer or strip of polysilicon material 62. The resistor 60 has two contacts 64, 66 used to form electrical connections between the resistor 60 and other circuit elements. The second polysilicon resistor 60 is connected in series with the source terminal of the NMOS transistor 70. In a preferred embodiment the polysilicon resistor 60 would also be connected to the transmission line 80. It must be noted that for illustrative purposes only, the resistors 50, 60 are polysilicon resistors and that any type of resistor or impedance element suitable for use within an integrated circuit may be used as the resistors 50, 60.

The source terminal of the transistor 70 is connected to the supply voltage $V_{SD}$. Therefore, the series connection of the transistor 70 and the second resistor 60 is connected in parallel with the first resistor 50. The gate terminal of the transistor 70 is connected to a DC control voltage $V_{DC}$.

Figure 2B:
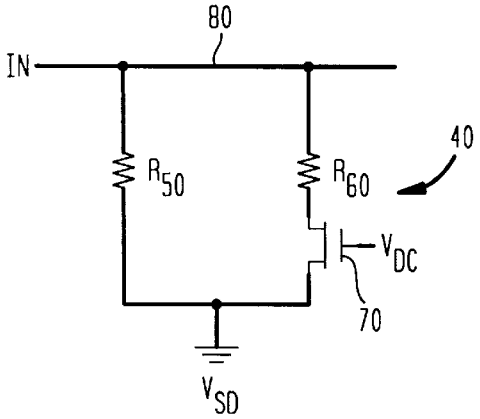
FIG. 2*b* illustrates the resistor circuit of FIG. 2*a* where the polysilicon resistors are represented by their known impedance.

FIG. 2*b* illustrates the resistor circuit 40 where the polysilicon resistors 50, 60 are represented by their known impedances $R_{50}$, $R_{60}$. Although not shown, the transistor 70 has an impedance $R_{70}$. As will be discussed below, the impedances $R_{50}$, $R_{60}$, $R_{70}$ will be chosen such that the circuit 40 always has a desired output impedance. In a preferred embodiment, the desired impedance would be the impedance of the transmission line 80.

The circuit 40 is designed such that its output impedance is the impedance $R_{50}$ of the first resistor 50 when the first resistor 50 has an impedance $R_{50}$ matching the desired impedance. To achieve this, the impedances $R_{60}$, $R_{70}$ are switched out of the circuit 40 by reducing the voltage applied to the gate of the transistor 70 below its threshold voltage. In the situations where the first resistor 50 has an impedance $R_{50}$ that is larger than the desired impedance, the circuit's 40 output impedance consists of the combination of all of the impedances $R_{50}$, $R_{60}$, $R_{70}$. This is done by switching in the impedances $R_{60}$, $R_{70}$ by increasing the voltage being applied to the gate of the transistor 70. The series combination of the transistor's 70 impedance $R_{70}$ and the second resistor's 60 impedance $R_{60}$ is combined in parallel with the impedance $R_{50}$ to create a circuit 40 impedance that matches the desired impedance.

It is desirable to have the impedance $R_{50}$ of the first resistor 50 match the desired impedance. As stated earlier, the impedance $R_{50}$ of the first polysilicon resistor 50 is directly related to the length of the polysilicon material 52 used to create the resistor 50. The sheet resistance, however, of the polysilicon material 52 can vary as much as ±30 percent of the expected impedance $R_{50}$ due to processing, temperature and power supply variations. Therefore, the length of the polysilicon material 52 used for the first resistor 50 is selected to be approximately 30 percent larger than the desired impedance for the resistor circuit 40. For example, if the circuit 40 were to be used to terminate a 50Ω transmission line 80, then the length of the polysilicon material 52 used for the first resistor 50 is selected such that its expected impedance $R_{50}$ is approximately 65Ω while its actual impedance $R_{50}$ can vary between 50Ω and 80Ω.

To compensate for the possible variations of the first resistor's 50 impedance $R_{50}$, the circuit 40 is designed to use the parallel combination of the first resistor 50 with the series connection of the second resistor 60 and transistor 70, as described above, when the impedance $R_{50}$ of the first resistor 50 is larger than the desired impedance. It must be noted that any processing variations that occur in the first resistor 50 will also occur in the second resistor 60 since they will be manufactured in the same process. Thus, it is possible to choose the impedance $R_{60}$ of the second resistor 60 and the impedance $R_{70}$ of the transistor 70 such that their series combination when combined in parallel with the impedance $R_{50}$ of the first resistor 50 will cause the circuit's 40 output impedance to match the desired impedance.

Figure 3:
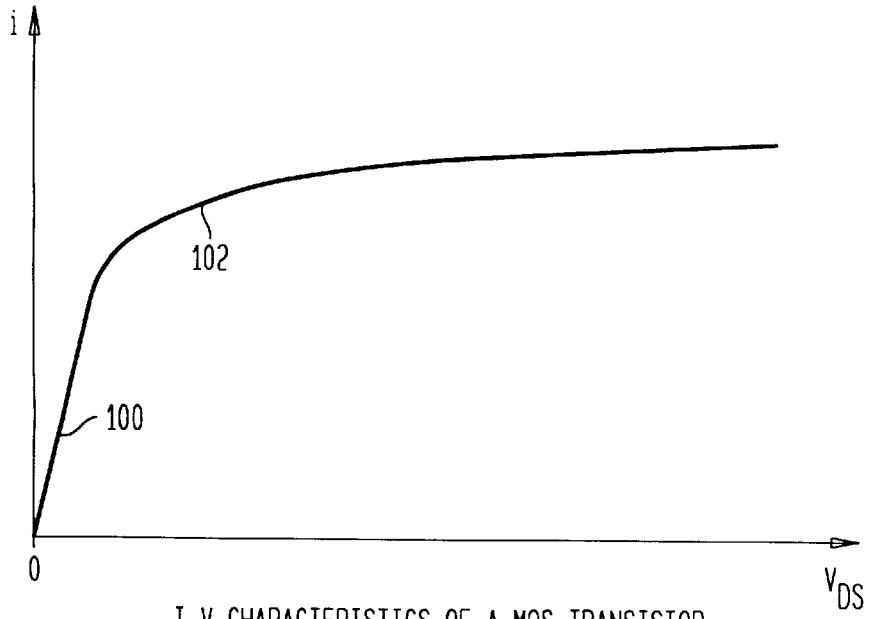
FIG. 3 illustrates a graph of the I–V characteristics of a MOS transistor.

It must be noted that the impedance $R_{70}$ of the transistor 70 will vary with the voltage applied to it since NMOS transistors have non-linear I–V characteristics. Referring now to FIG. 3, it can be seen that NMOS transistors have a very small linear region 100 and a much larger non-linear region 102. The slope of these regions 100, 102 represent the conductance (the inverse of impedance) of a NMOS transistor. The typical linear region 100 spans only a few tenths of a volt. Therefore, when a drain-to-source voltage on the CMOS transistor 70 becomes greater than a few tenths of a volt, its impedance $R_{70}$ increases dramatically. This provides an infinite number of potential impedances $R_{70}$ for the transistor 70 which when combined with the impedances $R_{50}$, $R_{60}$ of the resistors 50, 60 bolsters the circuit's 40 ability to maintain a well controlled impedance.

Figure 4:
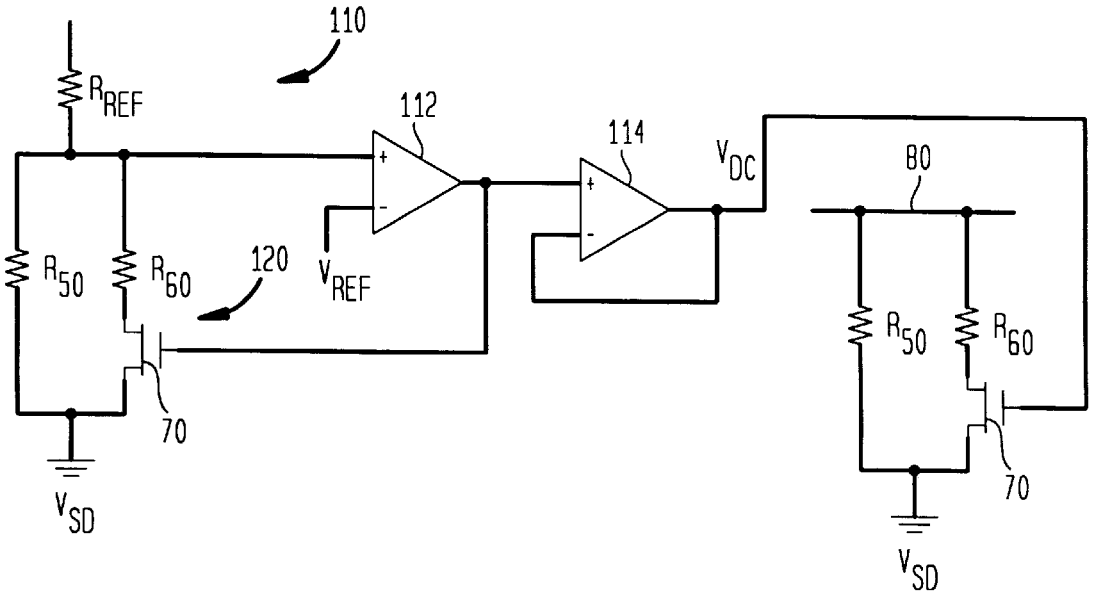
FIG. 4 illustrates an exemplary circuit used to generate a DC control voltage for controlling the impedance of the resistor circuit of FIGS. 2*a* and 2*b*.

In operation, the impedance of the circuit 40 is controlled by altering the DC voltage applied to the gate of the transistor 70. FIG. 4 illustrates an exemplary control circuit 110 used to generate and apply the proper DC threshold voltage to the transistor 70. It must be noted that this circuit 110 is only one exemplary technique of controlling the impedance of the circuit 40 and the invention is not to be limited solely to this technique. The circuit 110 includes a reference circuit 120 and two operational amplifiers (op-amps) 112, 114. The reference circuit 120 is exactly the same as the resistor circuit 40 (FIG. 2*b* ) because it has been manufactured by the same process that manufactured circuit 40. This way, any variations in the resistor circuit 40 are also present in the reference circuit 120. The one difference between the reference circuit 120 and the resistor circuit 40 is that a reference resistor $R_{REF}$ replaces the transmission line 80 in the reference circuit 120. The reference circuit 120 is connected to the non-inverting terminal of the first op-amp 112. The inverting terminal of the first op-amp 112 is connected to a reference voltage $V_{REF}$. The output of the first op-amp 112 is connected to the gate of the transistor 70 of the reference circuit 120 to provide further control of the reference circuit 120 and to the non-inverting terminal of the second op-amp 114. The output of the second op-amp 114 is used as the DC control voltage $V_{DC}$ to the resistor circuit 40 and is also fed back into its inverting terminal. Preferably, the second op-amp 114 is a unity gain amplifier which provides high impedance isolation.

The circuit 110 operates as follows. The reference voltage $V_{REF}$ and the reference impedance $R_{REF}$ are chosen such that the reference circuit 120 will simulate the resistor circuit 40 under operating conditions, such as, for example, when the circuit 40 is connected to a transmission line 80. The reference impedance $R_{REF}$ simulates the desired impedance while the reference voltage $V_{REF}$ is the voltage required by the reference circuit 120 to achieve the reference impedance $R_{REF}$. Accordingly, the reference voltage $V_{REF}$ and impedance $R_{REF}$ are application dependent.

The first amplifier 112 generates an output that causes the reference circuit 120 to have an impedance matching the reference impedance $R_{REF}$. Since the reference circuit 120 is exactly the same as the resistor circuit 40, the output of the first amplifier also causes the resistor circuit 40 to have the desired impedance. Initially, however, it is preferred that the output from the first amplifier 112 be fed through the second amplifier 114 to provide high impedance isolation prior to being sent to the resistor circuit 40. Accordingly, the output of the second amplifier is the DC control voltage $V_{DC}$. Thus, the control circuit 110 provides a DC control voltage $V_{DC}$ that can adjust the impedance of the resistor circuit 40 to compensate for any processing, operating temperature or power supply voltage variations.

Although the present invention has been described as part of an integrated circuit, it must be noted that the present invention may be utilized in any type of circuit, integrated or not, where a controlled impedance is desired. It must also be noted that the resistor circuit 40 can use additional resistors or transistors other than the second resistor 60 and the transistor 70 to help control the impedance of the circuit 40.

While the invention has been described in detail in connection with the preferred embodiments known at the time, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Accordingly, the invention is not to be seen as limited by the foregoing description, but is only limited by the scope of the appended claims.

What is claimed as new and desired to be protected by Letters Patent of the United States is:

1. A circuit for providing a controlled output impedance, said circuit comprising:

a first impedance element;

a second impedance element;

a third impedance element having a variable impedance responsive to a signal, said third impedance element being connected to said second impedance element in series and said second and third impedance elements being connected across said first impedance element, said circuit having an output impedance controlled by said signal and determined by a combination of impedances of said impedance elements; and a control circuit having a reference impedance, said control circuit generating said signal responsive to changes in electrical properties of said reference impedance which represent changes in said output impedance.

2. The circuit according to claim 1 wherein said signal is generated in response to variations in electrical properties of said impedance elements.

3. The circuit according to claim 1 wherein said first and second impedance elements are resistors.

4. The circuit according to claim 1 wherein said first and second impedance elements are polysilicon resistors.

5. The circuit according to claim 1 wherein said third impedance element is a NMOS transistor.

6. The circuit according to claim 3 wherein said third impedance element is a PMOS transistor.

7. The circuit according to claim 1 wherein said output impedance is controlled to match a desired impedance regardless of changes in the electrical properties of said impedance elements.

8. The circuit according to claim 1 wherein said signal is an analog DC voltage signal.

9. The circuit according to claim 1 wherein said control circuit comprises:

a reference circuit, said reference circuit including said reference impedance representing said output impedance;

an amplifier connected between said reference impedance and a reference voltage, said amplifier having said signal as an output.

10. An integrated circuit for providing a controlled output impedance, said circuit comprising:

a first impedance element;

a second impedance element; and a third impedance element having a variable impedance responsive to a signal, said third impedance element being connected to said second impedance element in series and said second and third impedance elements being connected across said first impedance element, said circuit having an output impedance controlled by said signal and determined by a combination of impedances of said impedance elements; and a control circuit having a reference impedance, said control circuit generating said signal responsive to changes in electrical properties of said reference impedance which represent changes in said output impedance.

11. The circuit of claim 10 wherein said signal is generated in response to variations in electrical properties of said impedance elements.

12. The circuit according to claim 10 wherein said first and second impedance elements are resistors.

13. The circuit according to claim 10 wherein said first and second impedance elements are polysilicon resistors.

14. The circuit according to claim 10 wherein said third impedance element is a NMOS transistor.

15. The circuit according to claim 10 wherein said third impedance element is a PMOS transistor.

16. The circuit according to claim 10 wherein said output impedance is controlled to match a desired impedance regardless of changes in the electrical properties of said impedance elements.

17. The circuit according to claim 10 wherein said signal is an analog DC voltage signal.

18. The circuit according to claim 10 wherein said control circuit comprises:

a reference circuit, said reference circuit including said reference impedance representing said output impedance;

an amplifier connected between said reference impedance and a reference voltage, said amplifier having said signal as an output.

19. A method of controlling the output impedance of an integrated circuit comprising:

providing a reference impedance;

generating a signal in accordance with variations in said reference impedance;

providing a resistor circuit having an output impedance, said resistor circuit including a plurality of impedance elements, each having a respective impedance; and selectively connecting together the impedance elements of said resistor circuit to form said output impedance in response to said output signal.

20. The method according to claim 19 wherein said resistor circuit includes a transistor and the step of selectively connecting together the impedance elements of said resistor circuit is performed by applying an analog voltage to the transistor.

21. A method of manufacturing an integrated circuit for providing a controlled output impedance, said method comprising:

providing a first impedance element;

providing a second impedance element;

providing a third impedance element having a variable impedance responsive to a signal, said third impedance element being connected to said second impedance element in series and said second and third impedance elements being connected across said first impedance element, said circuit having an output impedance determined by a combination of impedances of said impedance elements, said output impedance being controlled by said signal; and providing a control circuit having a reference impedance, said control circuit generating said signal responsive to changes in electrical properties of said reference impedance which represent changes in said output impedance.

22. The method according to claim 21 wherein the step of providing said control circuit comprises:

providing a reference circuit, said reference circuit including said reference impedance representing said output impedance; and providing an amplifier connected between said reference impedance and a reference voltage, said amplifier having said signal as an output.

* * * * *